United States Patent [19]

Franks et al.

[11] 3,944,873

[45] Mar. 16, 1976

[54] HOLLOW CATHODE TYPE ION SOURCE SYSTEM INCLUDING ANODE SCREEN ELECTRODES

[75] Inventors: Joseph Franks, London, England; Dennis John Baghurst, Newport, Wales

[73] Assignee: Ion Tech Limited, Middlesex, England

[22] Filed: Sept. 23, 1974

[21] Appl. No.: 508,793

[30] Foreign Application Priority Data

Sept. 24, 1973 United Kingdom ..... 44718/73

[52] U.S. Cl. ..... 315/111.8; 313/206; 313/209; 313/362

[51] Int. Cl.[2] .... H01J 7/24; H05B 7/06; H05H 1/00

[58] Field of Search ..... 313/210, 209, 362, 206, 313/207; 315/111.8

[56] References Cited

UNITED STATES PATENTS

| | | | |
|---|---|---|---|
| 3,262,003 | 7/1966 | Allen et al. | 313/207 |
| 3,320,475 | 5/1967 | Boring | 313/207 X |
| 3,411,035 | 11/1968 | Necker et al. | 313/210 X |
| 3,784,858 | 1/1974 | Franks | 250/290 |
| 3,831,052 | 8/1974 | Knechtli | 313/209 X |

*Primary Examiner*—Palmer C. Demeo

*Attorney, Agent, or Firm*—Woodhams, Blanchard and Flynn

[57] ABSTRACT

An ion source having an extremely high beam current density at low gas flow rates and therefore, low system pressures. The ion source includes an electrode system which consists of a cathode of, for example, spherical or cylindrical configuration which cathode encloses an anode having a pair of screen electrodes symmetrically disposed about and parallel to the plane of the anode, the anode and screen electrodes each having apertures formed therein. A gas inlet is formed in the cathode wall, preferably between the screen electrodes, and an ion beam outlet aperture of substantially the same size as the anode aperture is provided in the cathode. Upon application of suitable potentials to the anode, cathode and screen electrodes, the latter preferably being at a potential substantially equal to cathode potential, gas introduced through the gas supply inlet is ionised and the positive ions created are accelerated towards the cathode and emerge in a beam through the ion beam outlet aperture.

17 Claims, 8 Drawing Figures

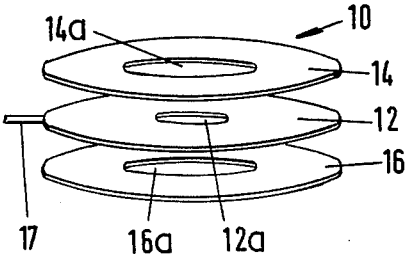
FIG. 1.
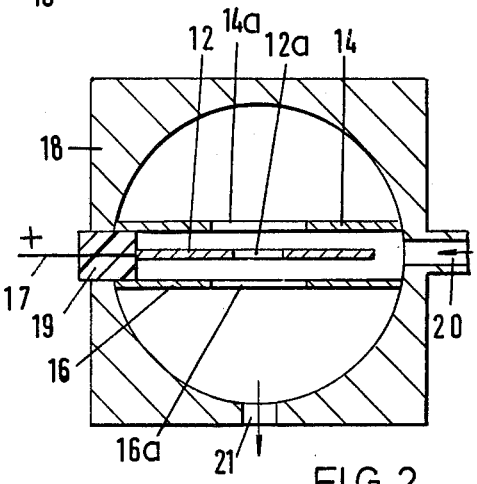
FIG. 2.
FIG. 3.
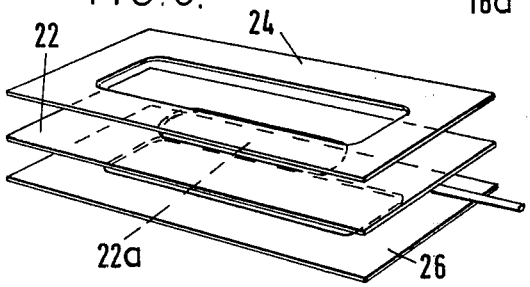
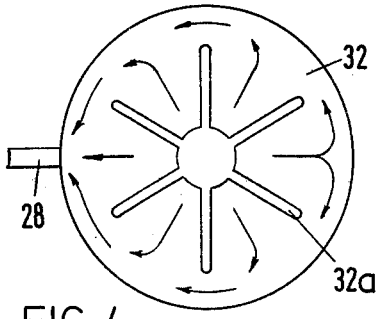
FIG. 4.
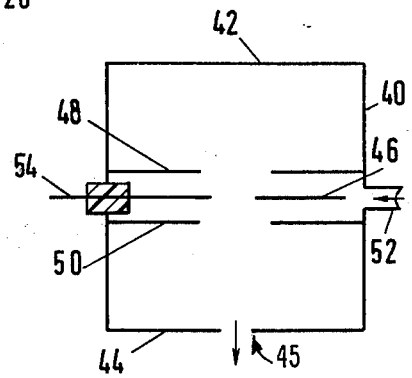
FIG. 5.

HOLLOW CATHODE TYPE ION SOURCE SYSTEM INCLUDING ANODE SCREEN ELECTRODES

The present invention relates to ion sources and has particular reference to charged particle oscillators of the kind described in the specifications of British Letters Pat. No. 1 158 782 and U.S. Pat. No. 3 784 858.

Ion sources of this kind generally comprise a cylindrical cathode encompassing two anode rods symmetrically disposed about the axis of the cylinder. An electron starting from rest within a specified region follows a long oscillatory path between the anode rods, thus creating ions in the residual gas before being captured by one or the other of the anode rods. The discharge extends along part of the length of the cylinder but terminates before reaching the ends of the cylinder, because here the field must be directed largely parallel to the axis instead of radially, in order to prevent electrons from drifting out of the cylinder. The cylinder is provided with end caps at cathode potential to prevent such drifting. The ends cannot however be maintained totally at cathode potential as there must be provision for the anode rods to pass through the end caps.

Ions emerge from an aperture in the cathode cylinder, where the plane of the discharge intersects the cathode wall. The gas to be ionised may be introduced into the vacuum chamber housing the cathode cylinder and will then enter the ion source through the cathode aperture. Alternatively, the gas may be introduced directly into the source through a tube in the cylinder wall or end caps, in which case the output of the source is enhanced and the physical size of the source can be reduced.

The cylindrical source, by reason of its geometry, produces an ion beam which is symmetrical about a plane containing the axis of the cylinder and normal to the plane containing the anodes.

The cylindrical source is especially useful for irradiating long specimens or large areas. The ion beam emerges along the length of the cathode cylinder and diverges radially from the source but does not widen appreciably in the axial direction.

For many purposes, an axially symmetrical beam would be preferable and this may be achieved, for example, with a source comprising a spherical cathode and an annular anode with its centre coinciding with the centre of the sphere. The ion beam will tend to be disposed symmetrically about the axis through the centre of the sphere normal to the annulus. Asymmetry will, however, be introduced by the electrical connection to the annulus which must pass through the wall of the sphere.

Such a spherical source, in which the cathode is of spherical configuration and encloses an anode which may conveniently be of annular configuration, produces an intense fine beam with little energy spread. The spherical source which can be compatible with ultra high vacuum equipment is suitable for etching, thinning and machining applications, being particularly suitable for preparing specimens for transmission electron microscopy.

The present invention has for an object the provision of an ion source in which the electrical connection to the anode which passes through the cathode does not introduce any significant perturbation of the field i.e. asymmetrical field on the operating part of the cathode.

According to the invention there is provided an ion source having an electrode system comprising a cathode and, mounted therein, an anode having an aperture formed therethrough and a pair of screen electrodes symmetrically disposed about and parallel to the anode, said screen electrodes having apertures therein larger than and concentric with the aperture in the anode.

The screen electrodes ensure that the field in the operating part of the source remains axially symmetrical and is undisturbed by electrical lead outs.

The cathode may be of cylindrical or spherical configuration and the anode and screen electrodes may be in the form of plates or may be of annular or cylindrical configuration.

Means may be provided for connecting the anode to a source of a positive potential and for connecting the screen electrodes to a source of potential substantially equal to that of the cathode potential.

The ion source may also comprise a gas inlet suitably extending through the cathode and preferably positioned between the screen electrodes and an ion beam outlet aperture.

The aperture in the anode may be made substantially the same size as that of the ion beam aperture in the cathode.

Other features of the invention will be described hereinafter and referred to in the appended claims.

The invention will now be described with reference to embodiments of the invention shown, by way of example, in the accompanying drawings, in which:

FIG. 1 shows a view of one embodiment of an electrode system according to the invention;

FIG. 2 shows a cross-section view of an ion source including the electrode system of FIG. 1;

FIG. 3 shows a view of another embodiment of an electrode system according to the invention;

FIG. 4 shows a plan view of a further embodiment of an anode for use in the invention; and, FIG. 5 is a cross-sectional view of another ion source according to the invention.

Figure 6:
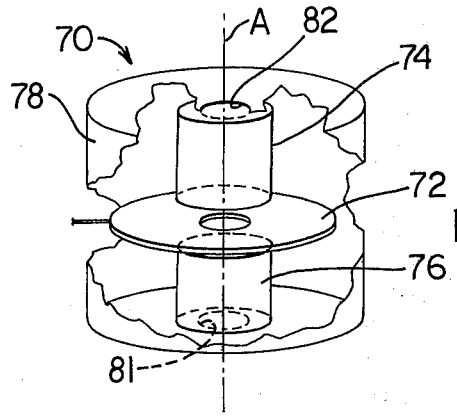
FIG. 6 is an oblique partially broken view of a further ion source according to the invention employing straight tubular screen electrodes.

Referring to FIGS. 1 and 2, there is shown an electrode structure 10 forming part of a spherical source and adapted to be enclosed within a cathode 18 (FIG. 2) the electrode structure comprising an anode 12 having a central aperture 12*a* disposed between two further screen electrodes 14, 16 at a potential substantially equal to cathode potential, the two screen electrodes having apertures 14*a*, 16*a* respectively, corresponding to the anode aperture 12*a*. As shown in FIGS. 1 and 2 the anode and screen electrodes are in the form of discs but they may be of cylindrical or dished annular configuration. The connection 17 through an insulator 19 in the cathode wall 18 to the anode 12 is made between the screen electrodes 14, 16 so that no asymmetric field is introduced. A gas inlet 20 is conveniently positioned between the screen electrodes and an ion beam outlet aperture 21 is provided in the wall of the cathode 18 as shown in FIG. 2.

This method of simulating an anode structure need not be confined to the axially symmetric case. For example, in FIG. 3 in the case of a source having a cylindrical cathode encompassing two anode rods the two anode rods could be replaced by an anode plate 22 situated in the plane of the anode rods with an aperture in the form of an elongated slot 22*a* along the axis of the cylinder. The anode plate would be screened on either side with screen electrodes in the form of plates 24, 26 at or near cathode potential with slots 24*a*, 26*a* respectively corresponding to that in the anode plate. The slots would terminate before reaching the ends of the cylinder.

The anode connection 28 between the screen electrodes would not cause any significant perturbation of the field in the operating part of the cylinder (FIG. 3). For efficient operation, the anode aperture 22*a* is made substantially the same size as the ion beam aperture in the cathode.

The screen electrodes 14, 16 or 24, 26 need not be at cathode potential, their potential could be raised to some intermediate value between anode and cathode potential or could be reduced below cathode potential, but not so low as to prevent a sufficient number of electrons reaching the cathode to maintain the discharge. If the screen electrode potential approaches anode potential too closely, or if the screen electrodes are omitted entirely, the source will not operate or will operate with reduced efficiency as electrons will drift away from the central operating region. In general it will be convenient to maintain the screen electrodes at cathode potential to avoid the need for separate screen electrode lead out connections; however in some applications and with a view to possible increased efficiency the screen potentials may be made slightly greater than the cathode potential.

Figure 7:
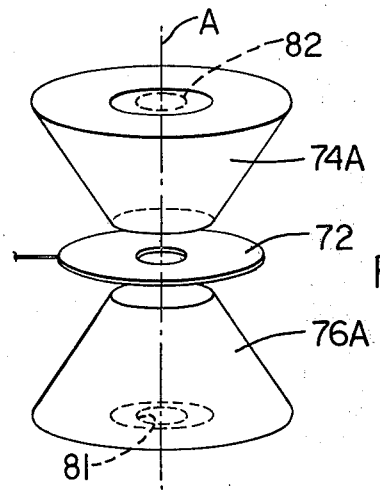
FIGS. 7 and 8 are oblique views of further electrode systems according to the invention employing conical screen electrodes.
Figure 8:
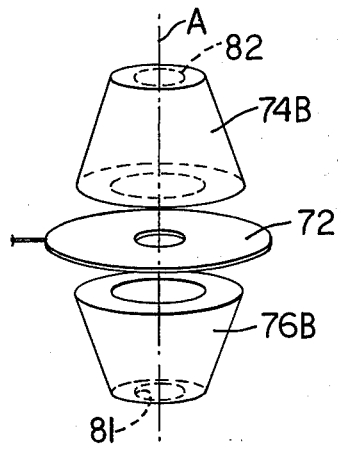

The screen electrodes may be flat plates or discs as shown in the drawings or may be more complex structures. Thus, for example, and as shown in FIG. 6, the screen electrodes may be tubes 74 and 76 with a cross-section at the anode 72 equal to the aperture 14a, 16a of the plates 14 and 16 of FIG. 1 and with axes coincident with the axis A of symmetry of the source 70, the ion outlet of which is indicated at 81. The tubes may extend from near the anode to near the cathode 78 and may be straight as in FIG. 6 or conical as in FIG. 7 at 74A and 76A and as in FIG. 8 at 74B and 76B. Furthermore, it is contemplated that the tubular screen electrodes may be made of separate parts each at a different potential.

The anode need not be a continuous plate. For example, as shown in FIG. 4 in the case of the spherical source, the anode 22 may be provided with radial slots 32*a* to improve the symmetry of the current flow.

An example of the spherical source has the following dimensions. Spherical cathode 22 mm diameter, anode aperture 5 mm, screen electrode apertures 10 mm, screen-anode separation 2 mm, ion beam aperture in cathode 4 mm. Typically an ion beam of about 600 $\mu$A is obtained with a source current of 2.5 mA at 5 kV at a chamber pressure of $2 \times 10^{-4}$ torr. The source produces an intense central beam which emerges with a diameter of about 1 mm and widens only slowly. At a distance of 38 mm from the source the diameter of the beam is about 2 mm. A less intense beam of ions also emerges from the source, filling the cathode aperture and spreading radially with a centre corresponding approximately to the centre of the source.

Many other structures which produce an electrostatic field with a single saddle configuration are possible using screened anodes. A simple structure shown in FIG. 5 related to the spherical case consists of a cylindrical tube 40 closed with plane electrodes 42, 44 at either end, one of these electrodes having the ion beam aperture 45 at its centre. The anode disc 46 and screens 48, 50 are disposed centrally in the cylinder and the gas inlet 52 is positioned between the screens. The anode connection 54 is made between the screen electrodes 48, 50 as in the previously described embodiments. This source has not been found as efficient as the spherical source.

In operation, upon application of suitable potentials to the anode, cathodes and screen electrodes and supply of gas to the source through the gas inlet, the gas is ionised, the positive ions created are accelerated towards the cathode and emerge as a beam through the ion beam outlet aperture. The beam produced by the cylindrical source diverges radially from the source but does not widen appreciably in the axial direction whereas the spherical source produces an intense fine beam with little energy spread.

An aperture, as at 82 in FIG. 6, may be made in the cathode diametrically opposite the first aperture. An ion beam will emerge through this second aperture, this beam may be used, for example, to monitor the output of the source.

We claim:

1. An ion source having an electrode system comprising:

a hollow cathode having an ion outlet in a wall thereof;

means for providing an ionizable gas in said cathode;

an anode mounted in an intermediate zone in the cathode and cooperable therewith for producing an electric field, said anode having an aperture therethrough aligned with said ion outlet;

means through the cathode wall for connecting the anode to a source of operating potential;

means for preventing perturbation of said field by said connecting means and comprising a pair of screen electrodes in said intermediate zone in said cathode and each having an aperture therethrough larger than and coaxial with the aperture in said anode, said pair of screen electrodes being symmetrically disposed in axially spaced sandwiching relation with respect to said anode.

2. An ion source as claimed in claim 1, in which said connecting means engages the outer periphery of said anode at a location radially outboard of said apertures of said screen electrodes.

3. An ion source as claimed in claim 2, in which said source is a source of positive potential and including means for connecting the screen electrodes to a source of potential substantially equal to that of the cathode.

4. An ion source as claimed in claim 2, in which said source is a source of positive potential and including means for connecting the screen electrodes to a source of potential intermediate the anode and cathode potentials.

5. An ion source as claimed in claim 1, wherein said gas providing means is a gas inlet located in the wall of the cathode intermediate the screen electrodes and remote from the ion beam outlet aperture.

6. An ion source as claimed in claim 5, in which the gas provided in said cathode is at a pressure of about $2 \times 10^{-4}$ Torr, said gas inlet being aligned in radial opposition to and being spaced from said anode.

7. An ion source as claimed in claim 1, wherein the cathode is in the form of a sphere, said anode being concentric with said spherical cathode, said screen electrodes being on opposite sides of the center of said spherical cathode, said anode and screen electrode apertures and ion outlet being coaxial with a diameter of said sphere.

8. An ion source as claimed in claim 1, wherein the anode is formed with a plurality of slots radiating from the center thereof, which center coincides with the center of the cathode.

9. An ion source as claimed in claim 1, wherein the cathode is in the form of a cylindrical tube closed at each end with a planar electrode, said ion outlet being an ion beam outlet aperture formed centrally in one of said planar end electrodes, said anode being axially centered in said tube.

10. An ion source as claimed in claim 1, wherein the anode and the screen electrodes are in the form of parallel plates, each with a single and central aperture.

11. An ion source as claimed in claim 10, in which the axial spacing of said screen electrode plates from each other and from said anode plate is less than the spacing of each of said screen electrode plates along its axis from the adjacent end of said cathode.

12. An ion source as claimed in claim 1, wherein the screen electrodes are of tubular configuration.

13. An ion source as claimed in claim 1, wherein the screen electrodes are of hollow conical configuration.

14. An ion source as claimed in claim 1, wherein the screen electrodes extend from near the anode to near the cathode.

15. An ion source as claimed in claim 14, wherein the screen electrodes are formed of separate parts, including means for connecting said parts to different potentials within a range of potentials substantially equal to the cathode potential.

16. An ion source as claimed in claim 1, in which said cathode is cylindrical, said anode and screen electrodes are parallel rectangular plates, each with a single substantially rectangular central aperture entirely laterally bounded by the perimetral edge portion of the plate, said plates and apertures extending axially of said cylindrical cathode, said anode plate lying in a diametral plane of said cylindrical cathode, the aperture in each screen electrode plate extending both axially and widthwise beyond the anode aperture.

17. An ion source as claimed in claim 1, wherein said cathode, anode and screen electrodes are all surfaces of revolution about a common axis, said cathode comprising two half-shells perimetrally joined at the central diametral plane of the cathode, said central diametral plane being occupied by said anode, at least one of said cathode halves coaxially being provided with a said ion outlet, said cathode half-shells and screen electrodes being mirror imaged across said diametral plane and anode.

* * * * *